US006735411B2

(12) United States Patent
Dickhoff et al.

(10) Patent No.: US 6,735,411 B2
(45) Date of Patent: May 11, 2004

(54) COMPLIANT INTERMEDIATE TRANSFER ROLLER WITH FLEXIBLE MOUNT

(75) Inventors: Andreas Dickhoff, Kirchheim Teck (DE); Andrew Peter Kittleson, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 46 days.

(21) Appl. No.: 10/177,265

(22) Filed: Jun. 21, 2002

(65) Prior Publication Data

US 2003/0235444 A1 Dec. 25, 2003

(51) Int. Cl.[7] ..... G03G 15/01

(52) U.S. Cl. ..... 399/299; 399/302; 399/313; 100/171

(58) Field of Search ..... 399/299, 302, 399/303, 308, 306, 318, 313; 100/159, 168, 169, 171, 176

(56) References Cited

U.S. PATENT DOCUMENTS

| | | | | | |
|---|---|---|---|---|---|
| 2,850,952 | A | * | 9/1958 | Hornbostel | 100/163 A |
| 4,087,169 | A | * | 5/1978 | Fantuzzo | 399/313 |
| 4,798,134 | A | * | 1/1989 | Beery et al. | 100/171 |
| 4,802,439 | A | * | 2/1989 | Sugimoto et al. | 118/116 |
| 5,084,735 | A | | 1/1992 | Rimai et al. | 355/271 |
| 5,187,526 | A | | 2/1993 | Zaretsky | 355/273 |
| 5,283,621 | A | * | 2/1994 | Hashizume | 399/331 |
| 5,370,961 | A | | 12/1994 | Zaretsky et al. | 430/126 |
| 5,374,982 | A | * | 12/1994 | Boockkholdt | 399/318 |
| 5,678,150 | A | * | 10/1997 | Takahashi et al. | 399/299 |
| 5,701,567 | A | | 12/1997 | Bucks et al. | 399/302 |
| 5,715,505 | A | | 2/1998 | Tombs et al. | 399/299 |
| 5,799,232 | A | * | 8/1998 | Tompkins et al. | 399/167 |
| 5,828,931 | A | | 10/1998 | May et al. | 399/159 |
| 6,009,298 | A | * | 12/1999 | Sakamaki et al. | 399/318 |
| 6,549,745 | B2 | * | 4/2003 | May et al. | 399/302 |

FOREIGN PATENT DOCUMENTS

| | | | | |
|---|---|---|---|---|
| JP | 08339112 | A * | 12/1996 | G03G/15/01 |
| JP | 2001075377 | A * | 3/2001 | G03G/15/16 |

* cited by examiner

*Primary Examiner*—Robert Beatty
(74) *Attorney, Agent, or Firm*—Lawrence P. Kessler

(57) ABSTRACT

In a reproduction apparatus having a rotatable imaging roller upon which an image is formed, and a rotatable transfer roller for transferring an image from the imaging roller to a receiver member, a device for mounting the transfer roller to substantially compensate for changes in engagement between the imaging roller and the transfer roller during image transfer. The mounting device includes a bearing assembly for supporting the transfer roller for rotation. A flexible member is associated with the bearing assembly. The flexible member provides movement of the bearing assembly by urging the bearing assembly in a direction to maintain, at least over a limited distance, the transfer roller in constant force engagement with the imaging roller so as to substantially prevent any change in the angular speed relationship therebetween.

8 Claims, 3 Drawing Sheets

COMPLIANT INTERMEDIATE TRANSFER ROLLER WITH FLEXIBLE MOUNT

FIELD OF THE INVENTION

This invention relates to a flexible support for a transfer roller of a reproduction apparatus.

BACKGROUND OF THE INVENTION

In the art of commercial copiers and printers, in the transfer process, the use of a noncompliant intermediate transfer member to transfer a toner image from an imaging member to a print media (e.g., paper) is well known. Both Rimai et al. (U.S. Pat. No. 5,084,735, issued on Jan. 28, 1992) and Zaretsky et al. (U.S. Pat. No. 5,370,961, issued on Dec. 6, 1994) show that by using an intermediate transfer roller (IT), composed of a thick compliant layer with a relatively thin stiff overcoat, the quality of toner transfer is improved when compared to non-compliant intermediates. Zaretsky (U.S. Pat. No. 5,187,526, issued on Feb. 16, 1993) describes that transfer can be improved by separately specifying the resistivity of the IT and the second transfer roller, which forms a nip for transfer to paper. Bucks et al. (U.S. Pat. No. 5,701,567, issued on Dec. 23, 1997) describes an IT having electrodes embedded in a compliant blanket to spatially control the applied transfer field. Tombs et al. (WO Patent Application No. 98/04961, dated Feb. 5, 1998) describes the use of a compliant IT in conjunction with a transport web in a multicolor electrophotographic machine. May et al. (U.S. Pat. No. 5,828,931, issued on Oct. 27, 1998 and U.S. Pat. No. 5,715,505, issued on Feb. 3, 1998) describe a compliant imaging member including a thick compliant blanket coated with a thin photoconductive material. The above-mentioned patents describe the benefits of using a compliant layer. However, the compliant layer complicates image-to-image registration of different colors on the print media.

SUMMARY OF THE INVENTION

In view of the above, the purpose of this invention is to improve image-to-image registration in multicolor electrophotographic or electrostatographic reproduction apparatus when using a compliant layer intermediate transfer roller by providing a flexible mount for the intermediate transfer roller (IT). The IT mount can be used in apparatus that either collect different color images in register on the IT then transfer them to print media (see FIGS. 7 and 9 of aforementioned WO 98/04961), or in apparatus that collect images in register on paper such as in parallel machines (see FIG. 8 of aforementioned WO 98/04961). An additional embodiment of the apparatus according to this invention collects the image on the print media using sequential passes of the media through the IT transfer nip where only a single IT is used.

The IT mount according to this invention includes sheet metal flexures (i.e., leaf springs) that constrain five degrees of freedom of the IT in an advantageous way. The leaf springs passively adjust the engagement between the IT and the photoconductor drum (PC). This adjustment is driven by the runout of PC and the IT. The amount of adjustment is mainly determined by the stiffness of the sheet metal flexures. By changing the dimensions or material properties of the leaf springs, the adjustment can be chosen such that the effect of the PC and IT runout on the color-to-color registration is greatly reduced. In addition, the changes in engagement due to runout in the PC and the IT is reduced significantly.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
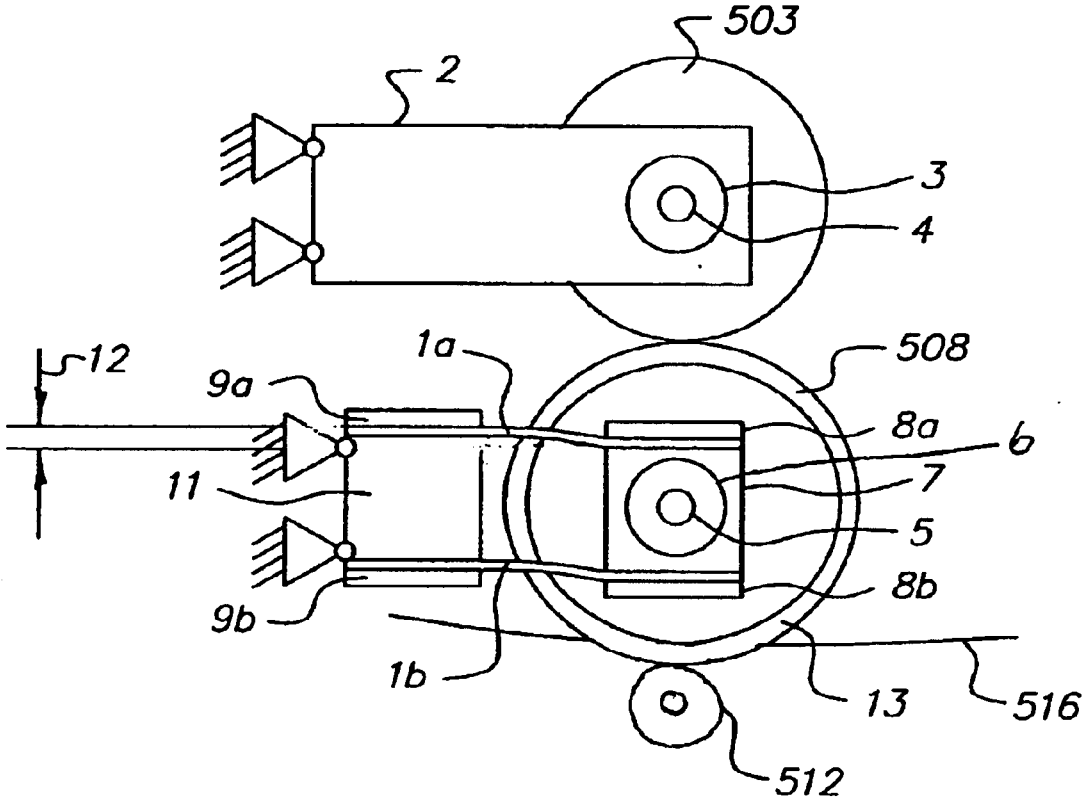
FIG. 1 is a side elevational view of a portion of a print module for an electrographic reproduction apparatus, with portions removed to facilitate viewing, including a flexible intermediate transfer roller mount according to this invention.
Figure 3:
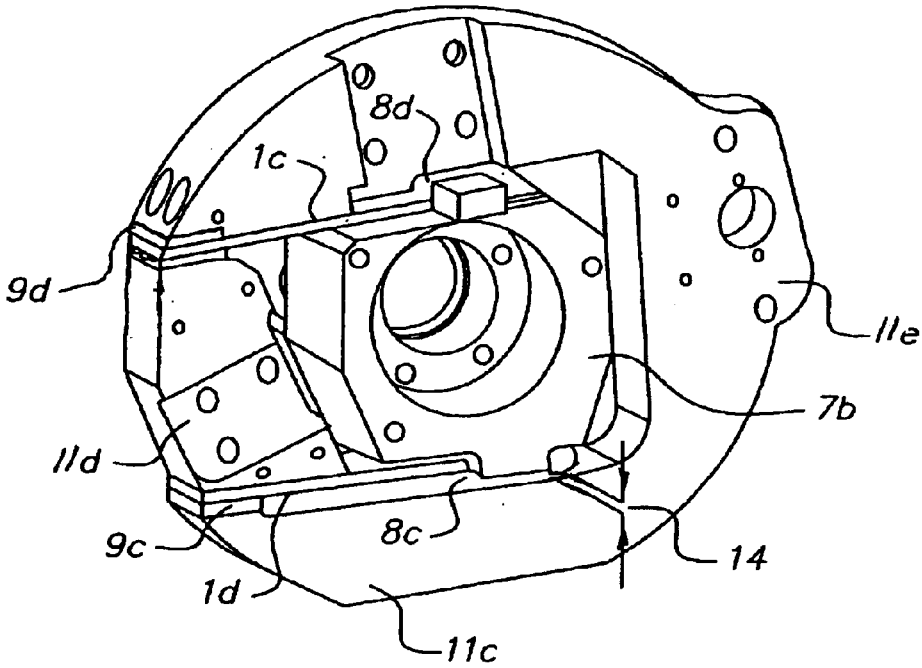
FIG. 3 is a view in perspective, on an enlarged scale, of the rear flexible intermediate transfer roller mount of FIG. 1 according to this invention.
Figure 4:
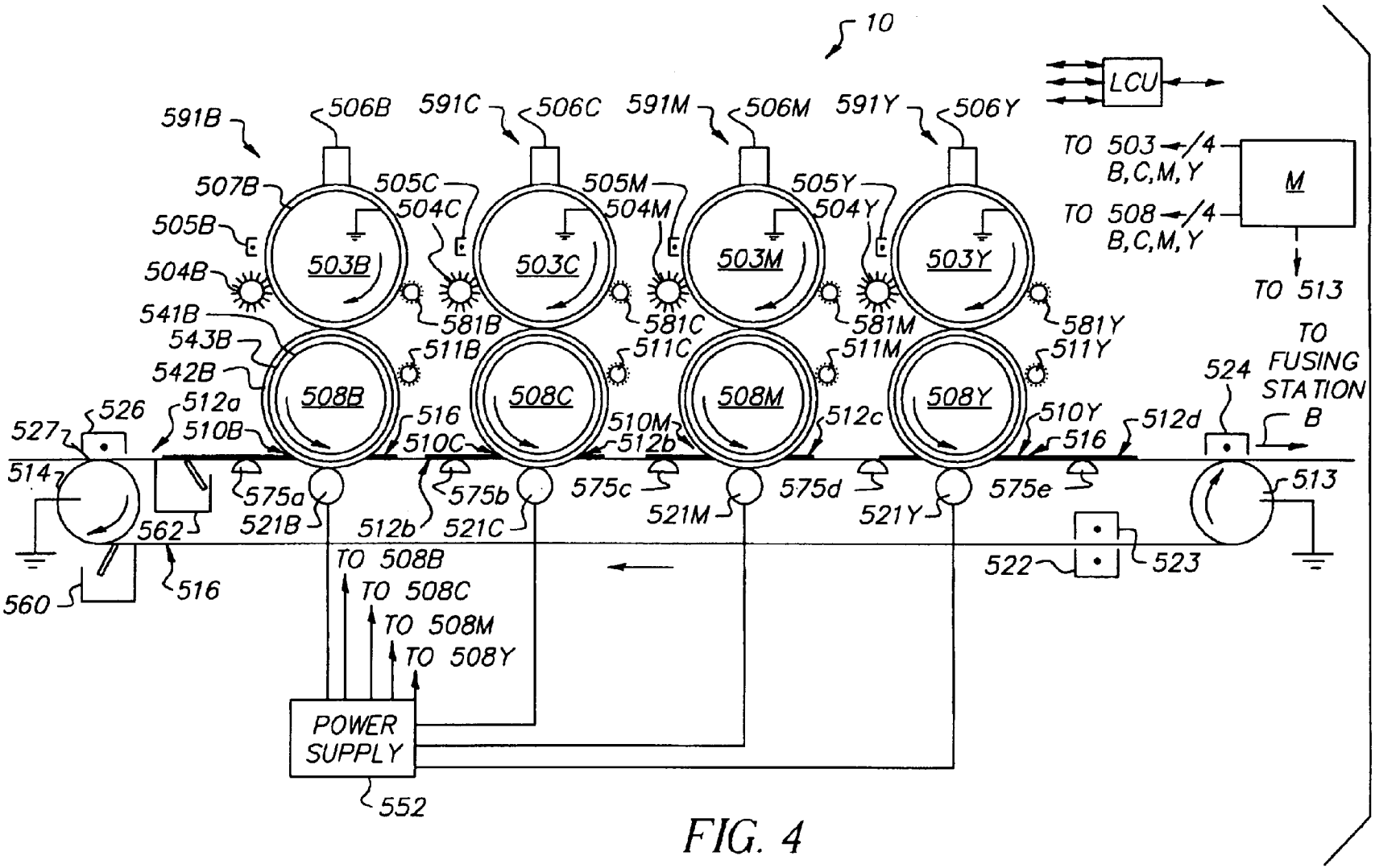
FIG. 4 is a schematic illustration of an exemplary multicolor electrographic reproduction apparatus including intermediate transfer rollers suitable for utilizing the flexible mounts according to this invention.

In FIG. 4, an exemplary multicolor electrographic reproduction apparatus 10 is shown schematically. In the reproduction apparatus 10, a transport web 516 is driven and in turn drives the IT's (508B, 508C, 508M, 508Y) and imaging member PC's (503B, 503C, 503M, 503Y). The imaging member PC's are engaged with the IT's by flexible members 1*a*, 1*b*, 1*c* and 1*d* (see FIGS. 1–3) according to this invention. The IT's (508B, 508C, 508M, 508Y) are constructed as shown in aforementioned Rimai et al. and Zaretsky et al. patents to be compliant, so that when engaged against the imaging members, the compliant layer or elastomer deforms creating a defined transfer nip.

A variety of imaging defects, including color shifts and other registration errors, occur if the angular speed ($\omega_{it}$) of the IT and the angular speed ($\omega_{pc}$) of the PC vary relative to each other when the image is transferred to the IT or written to the PC. The relation of the angular speed between the PC and the IT is called the speed ratio (C). The speed ratio (C) is defined through:

$$C = \frac{\omega_{pc}}{\omega_{it}} \tag{1}$$

In order to prevent image defects, it is therefore desirable to reduce and/or eliminate any changes in the speed ratio (C).

The speed ratio equation can be expanded into the following equation:

$$C = \frac{\omega_{pc}}{\omega_{it}} = \frac{R_{it}}{R_{pc}} \times (1 + S \times E) \tag{2}$$

where $R_{pc}$ is the radius of the PC (503), $R_{it}$ is the radius of the undeformed IT drum (508), E is an engagement factor representing the interference between the PC and IT drums and S is a constant factor representing speed ratio sensitivity. This factor S is a function of the diameters of the PC and IT and the thickness and the material properties of the IT compliant blanket. The interference between the PC and IT drums (factor E) is primarily determined by the PC and IT runout. The runout is defined as the deviation of the radius of the PC, or the IT, from the selected radius as a function of the angular position.

The most common way, in the prior art, to mount an IT and respective PC is with the axis of the drums mounted at a constant spacing. In such an arrangement, any change in runout will result in a change in interference and engagement, which can cause toner transfer artifacts. For the configuration of the reproduction apparatus 10 of FIG. 4, the value for speed ratio sensitivity (S) is between 33/m and 40/m depending on the material and geometric properties (thickness, for example) of the IT compliant blanket. If this speed ratio sensitivity (S) is smaller than $1/R_{pc}$, the speed ratio C will increase with an increase of the PC drum radius due to runout. The speed ratio C will decrease if S is larger than $1/R_{pc}$. In the specific case of the exemplary reproduction apparatus 10, the speed ratio sensitivity (S) is roughly three times larger than $1/R_{pc}$. That means that the larger the PC radius is, the smaller the speed ratio C is.

Another known way of mounting an IT and respective PC is to engage the IT and the PC with constant force. That means that the PC and the IT are engaged with a constant force and the distance between the centers of the two drums is constantly changing proportional to the changes in runout while the drums are rotating. In the constant force case, where the engagement between IT and PC is constant, the speed ratio C is only a function of the two radii because the engagement is not changing (see equation 2 above with E=constant).

In between the constant spacing and the constant force engagement IT/PC mounting methods is the flexible engagement according to this invention. One of the two drum centers is fixed in space and the other one is engaged with a defined spring constant. The nominal engagement is achieved with a defined spring engagement 12 (see FIG. 1). The equation from above can be expanded to:

$$C = \frac{\omega_{pc}}{\omega_{it}} = \frac{R_{it}}{R_{pc}}\left[1 + E\left[S\frac{\left[\frac{1}{\left(\frac{1}{K_f} + \frac{1}{K_s}\right)^{-1}} + \frac{1}{K_{bd}}\right]^{-1}}{K_{bd}}\right]\right] \tag{3}$$

where $K_f$ is the stiffness of a flexure spring (1*a*, 1*b*) in Z-direction, $K_{bd}$ is the stiffness (in N/mm) of the IT blanket (13) engaged against the PC (503) and $K_s$ is the combined stiffness of all other parts in the IT mount, in the Z-direction, that add flexibility to the drum engagement. $K_{bd}$ is given by the blanket material properties and the drum geometry as well. $K_s$ is mainly given by the design of the respective shafts 4 and 5. In the ideal case, the speed ratio C is constant and the only parameter than can be changed freely is the stiffness $K_f$ of the flexure springs.

The ideal case is given by the following equation:

$$S\frac{\left[\frac{1}{\left(\frac{1}{K_f} + \frac{1}{K_s}\right)^{-1}} + \frac{1}{K_{bd}}\right]^{-1}}{K_{bd}} = \frac{1}{R_{pc}} \tag{4}$$

solving for $K_f$:

$$K_f = K_s\frac{K_{bd}}{(S\ K_s\ Rpc - K_{bd} - K_s)} \tag{5}$$

For the configuration of the exemplary embodiment, the flexure stiffness has been determined to be a stiffness $K_f$ of 1360 N/mm–1500 N/mm. When the stiffness of the flexure is adapted perfectly to the exemplary configuration, the errors in the speed ratio (C) can be reduced by 50%–90%. The flexure is especially effective for the reduction of PC runout. The effects of PC runout on the speed ratio C can be reduced by 90%. The higher the PC runout is, the more effective the flexure is in reducing the runout effect. The effects of the IT runout on the speed ratio can be reduced by 40–60%. Overall, the engagement changes when using the flexure mount are smaller than the engagement changes in the constant spacing configuration, but larger than in the constant force case.

In the preferred embodiment of the flexure spring according to this invention, the flexure spring is configured as a "parallel spring". A parallel spring is the combination of two leaf springs (see front flexure in FIGS. 1 and 2, items 1*a* and 1*b*, and rear flexure in FIG. 3, items 1*c* and 1*d*). The ends of the leaf springs 1*a*, 1*b* on the right side are rigidly connected by the parts 7 and 8*a*, 8*b*, and the ends on the left are rigidly connected by the parts 9*a*, 9*b* and 11. The parts 1*a*, 1*b*, 7, 8*a*, 8*b*, 9*a*, 9*b* and 11 form a rectangular frame with two rigid sides (parts 7 and 11) and two flexible sides (leaf springs 1*a*, 1*b*). The two rigid sides can only move parallel to each other. Since one end of this frame (part 11) is mounted in a fixed location, the other side (part 7) has only one degree of freedom left. Part 7 can only move up and down, in the Z direction, controlled by the stiffness of the flexures (leaf springs 1*a*, 1*b*). There are two parallel spring assemblies, one in the front and one in the back of the reproduction apparatus 10, each supporting one end of the IT shaft 5. The IT shaft 5 is supported in the bearings 6, which are in turn supported in the parts 7*a*, 7*b*, respectively in the front and back of the reproduction apparatus 10. As an alternative assembly, it can, of course, in certain circumstances be advantageous to reverse the setup and mount the IT in a fixed manner, and to provide a similar flexible mount for the PC.

Figure 2:
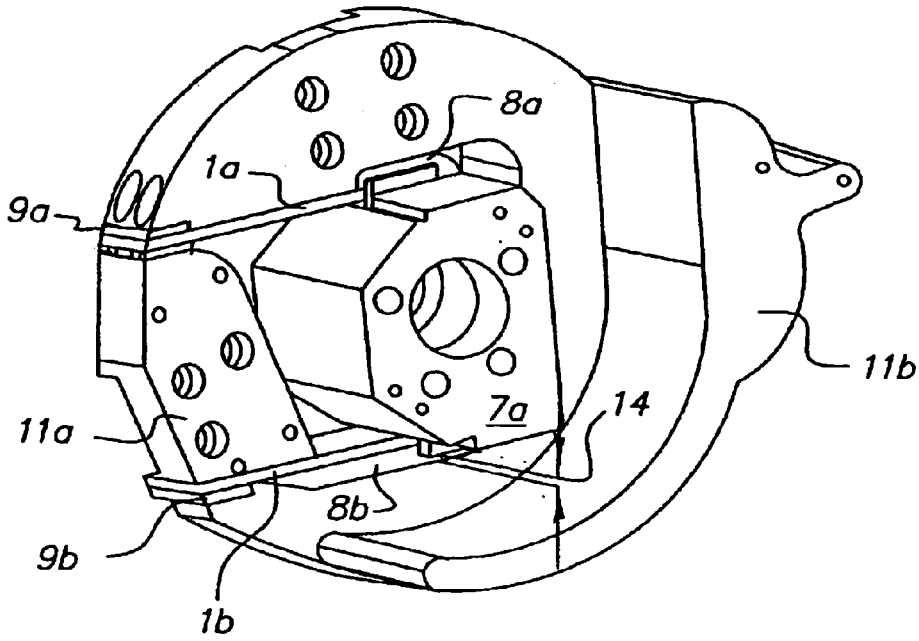
FIG. 2 is a view in perspective, on an enlarged scale, of the front flexible intermediate transfer roller mount of FIG. 1 according to this invention.

FIGS. 2 and 3 respectively show the integration of the leaf springs 1*a*, 1*b*, and 1*c*, 1*d* into an IT mount. The parts 11*a*, 11*b* and 11*c*, 11*d* are respectively mounted, in any suitable manner, to the frame of the reproduction apparatus (shown in FIG. 4), and as such have a fixed location during operation. A safety gap (designated by numerals 14*a*, 14*b*, respectively in FIGS. 2 and 3) is provided between the parts 7*a* and 8*b*, and between the parts 7*b* and 8*c* respectively. The safety gap is determined to provide only a maximum allowable deflection of the springs 1*a*, 1*b*, and 1*c*, 1*d*, in the –Z direction. At any larger deflection of the leaf springs, the parts 7*a* and 11*b*, and the parts 7*b* and 11*e* come into physical contact and prevent the flexures from further deformation. Similarly, in the +Z direction the parts 11*b* and 11*e* are respectively engaged by parts 8*a* and 8*d* to prevent significant deformation of the flexures.

The front flexures 1*a*, 1*b*, and the rear flexures 1*c*, and 1*d* are preferably made out of spring steel, but other materials such as, for example, aluminum or brass as well as glass or carbon fiber reinforced plastic can be used. For the parts 7*a*, 7*b*, 11*a*, 11*b*, 11*c*, and 11*e*, cast iron, aluminum as well as glass or carbon fiber reinforced plastic can, for example, be used. The dimensions of the flexure springs in the preferred embodiment are selected to be 55 mm by 21.6 mm by 2.5 mm (flexing length, between parts 9*a*, 9*b* and between parts 9*c*, 9*d*, respectively, by width by thickness). Of course, these selected dimensions can vary greatly, depending on the spring material and the space available. In general the length can vary from 10 mm–150 mm, the width from 3 mm–50 mm and the thickness from 0.1 mm–8 mm.

As discussed above, FIG. 4 shows an exemplary image forming reproduction apparatus designated generally by the numeral 10 The reproduction apparatus 10 is in the form of an electrophotographic reproduction apparatus, and more particularly a color reproduction apparatus wherein color separation images are individually formed in each of four colors. The color separation images are transferred in register to a receiver member as such receiver member is moved through the apparatus while supported on a transport web 516. The exemplary apparatus features four substantially similar color modules (591B, 591C, 591M, 591Y).

Each of the four color modules (591B, 591C, 591M, 591Y) is of similar construction except that, as shown, one transport belt 516 operates with all the modules, a receiver member being transported by the belt 516 from module to module and each module having a different color image developer associated therewith. The elements in FIG. 4 that are similar from module to module have similar reference numbers with a suffix of B, C, M, and Y, referring to the color module to which it is associated. Four receiver members or sheets 512*a*, 512*b*, 512*c*, and 512*d* are shown simultaneously receiving images from the different modules, it being understood, as noted above, that each receiver member may receive one color image from each module, and that up to four color images can be received by each receiver member. The movement of the receiver member with the belt 516 is such that each color image transferred to the receiver member at the transfer nip of each module must be transferred so as to be registered with the previous color transfer so that a four-color image formed on the receiver member has the colors in registered superposed relationship on the receiver member. The receiver members are then sent seriatim to a fusing station (not shown) to fuse or fix the dry toner images to the respective receiver members. The belt is reconditioned by providing charge to both surfaces using, for example, opposed corona chargers 522, 523, which neutralize charge on the surfaces of the belt.

Each color module includes a primary image forming member, for example a drum 503B, 503C, 503M, and 503Y, respectively. Each drum 503B, 503C, 503M, and 503Y has a photoconductive surface, upon which a pigmented marking particle image (or alternatively, a series of different color marking particle images) is formed. In order to form images, the outer surface of the drum is uniformly charged by a primary charger such as a corona charging device 505B, 505C, 505M, and 505Y, respectively, or other suitable charger such as roller chargers, brush chargers, etc. The uniformly charged surface is exposed by suitable exposure device, such as, for example, an LED exposure device 506B, 506C, 506M, and 506Y, respectively, or a laser or other electro-optical exposure device, or even an optical exposure device. The exposure device selectively alters the charge on the photoconductive surface of the drum to create an electrostatic image corresponding to an image to be reproduced. The electrostatic image is developed by application of pigmented marking particles to the latent image bearing a photoconductive drum by a development station 581B, 581C, 581M, and 581Y, respectively. The development station is a particular color of pigmented toner marking particles associated respectively therewith. Thus, the modules create a series of different color marking particle images (color separation images) on the respective photoconductive drums.

Each marking particle image is transferred to an outer surface of a respective secondary (or intermediate transfer) member, for example, an intermediate transfer roller (ITR) 508B, 508C, 508M, and 508Y, respectively. After transfer, residual marking particles and dust are cleaned from the surface of the photoconductive drum by a suitable cleaning device 504B, 504C, 504M, and 504Y, respectively, to prepare the surface for reuse for forming subsequent toner images.

A single color-marking particle image, respectively formed on the outer surface of the intermediate transfer member drum (one identified as numeral 542B in FIG. 4 and the others not identified), is transferred to a receiver member, is fed sequentially into a nip between the intermediate image transfer member drums and a transfer backing roller 521B, 521C, 521M, and 521Y, respectively. The transfer backing rollers are suitably electrically biased by power supply 552 to induce the charged toner particle image to transfer to the receiver member. The receiver member is fed from a suitable receiver member supply (not shown) and moves serially into each of the nips 510B, 510C, 510M, and 510Y where it receives the respective marking particle image. The receiver member exits the last nip and is transported by a suitable transport mechanism (not shown) to a fuser (not shown) where the marking particle image is fixed to the receiver member by application of heat and/or pressure. A detack charger 524 may be provided to deposit a neutralizing charge on the receiver member to facilitate separation of the receiver member from the belt 516. The receiver member with the fixed marking particle image is thereafter transported to a remote location for operator retrieval. The ITR is cleaned by a cleaning device 511B, C, M and Y to prepare it for reuse.

In view of the above description, it is readily apparent that, with the use of the invention of the flexible mounts for the compliant intermediate transfer member, in the preferred embodiment, there is a significant reduction in engagement sensitivity of speed ratio to runout of the photoconductor drum and the associated intermediate transfer drum. This is desired for accurate color registration of the individual color separation images one on another to form an accurate reproduction, which is substantially defect free. Further, the engagement variation is greatly reduced compared to the described constant spacing configuration. This leads to a more constant nip width, which is important for a constant image quality at the image transfer from the photoconductor drum to the associated intermediate transfer drum.

The invention has been described in detail with particular reference to certain preferred embodiments thereof, but it will be understood that variations and modifications can be effected within the spirit and scope of the invention.

What is claimed is:

1. A device for mounting a first roller relative to a second roller adapted to form a rotatable nip therebetween so as to substantially compensate for changes in engagement between said first roller and said second roller, said mounting device comprising:

a bearing assembly for supporting said first roller for rotation;

a flexible member associated with said bearing assembly, said flexible member including a parallel spring arrangement, to limit movement of said bearing assembly to movement with a single degree of freedom, said parallel spring arrangement including a part positioned at a fixed spatial location, a first flexure connected between said part and said bearing assembly, and a second flexure connected between said part and said bearing assembly, said second flexure being of substantially equal dimensions to said first flexure and oriented parallel to said first flexure so as to provide movement of said bearing assembly by urging said bearing assembly in a direction to maintain, at least over a limited distance, said first roller in constant force engagement with said second roller so as to substantially prevent any change in the angular speed relationship therebetween; and a stop member to limit movement of said bearing assembly by said parallel spring arrangement.

2. The mounting device according to claim 1 wherein said respective first and second flexures are leaf springs.

3. In a reproduction apparatus having a rotatable imaging roller upon which an image is formed, and a rotatable transfer roller for transferring an image from said imaging roller to a receiver member, a device for mounting said transfer roller to substantially compensate for changes in engagement between said imaging roller and said transfer roller during image transfer, said mounting device comprising:

a bearing assembly for supporting said transfer roller for rotation;

a flexible member associated with said bearing assembly, said flexible member includes a parallel spring arrangement so as to limit movement of said bearing assembly to movement with a single degree of freedom providing movement of said bearing assembly by urging said bearing assembly in a direction to maintain, at least over a limited distance, said transfer roller in constant force engagement with said imaging roller so as to substantially prevent any change in the angular speed relationship therebetween; and a stop member to limit movement of said bearing assembly by said parallel spring arrangement.

4. The mounting device according to claim 3 wherein said parallel spring arrangement includes a part positioned at a fixed spatial location, a first flexure connected between said part and said bearing assembly, and a second flexure connected between said part and said bearing assembly, said second flexure being of substantially equal dimensions to said first flexure and oriented parallel to said first flexure.

5. The mounting device according to claim 4 wherein said respective first and second flexures are leaf springs.

6. In a multicolor reproduction apparatus having a plurality of printing modules for forming a plurality of transferable color separation images respectively, each module including a rotatable imaging roller upon which an image is formed and a rotatable transfer roller for transferring an image from said imaging roller to a receiver member in superimposed register with color separation images from other of said printing modules, a device for mounting each of said transfer rollers to substantially compensate for changes in engagement between said imaging roller and its associated said transfer roller during image transfer, said mounting device comprising:

a plurality of bearing assemblies, each bearing assembly respectively supporting an end of one of said transfer rollers for rotation therein; and a plurality of flexible members associated with said plurality of bearing assemblies respectively, each of said flexible members includes a parallel spring arrangement so as to limit movement of its associated said bearing assembly to movement with a single degree of freedom providing movement of its associated said bearing assembly by urging said bearing assembly in a direction to maintain, at least over a limited distance, said respective transfer roller in constant force engagement with said respective imaging roller so as to substantially prevent any change in the angular speed relationship therebetween; and a plurality of stop members, associated with said plurality of bearing members respectively, to limit movement of said bearing assembly by said parallel spring arrangement.

7. The mounting device according to claim 6 wherein each of said parallel spring arrangements includes a part positioned at a fixed spatial location, a first flexure connected between said part and said bearing assembly, and a second flexure connected between said part and said bearing assembly, said second flexure being of substantially equal dimensions to said first flexure and oriented parallel to said first flexure.

8. The mounting device according to claim 7 wherein said respective first and second flexures are leaf springs.

* * * * *